United States Patent [19]

Merner et al.

[11] Patent Number: 4,602,878

[45] Date of Patent: Jul. 29, 1986

[54] IDEOGRAPHIC WORD PROCESSOR

[75] Inventors: Mark Merner; Douglass A. White, both of Fairfield, Iowa; Kanemichi Takeuchi, Ichikawa, Japan

[73] Assignee: Iograph Corporation, Menlo Park, Calif.

[21] Appl. No.: 515,926

[22] Filed: Jul. 20, 1983

[51] Int. Cl.[4] ..... B41J 5/10

[52] U.S. Cl. ..... 400/110; 400/484; 400/487; 400/490; 400/493

[58] Field of Search ..... 400/110, 484, 487, 490, 400/493; 340/731, 751

[56] References Cited

U.S. PATENT DOCUMENTS

| | | | |
|---|---|---|---|
| 662,834 | 11/1900 | Tcherkasson | 400/487 |
| 706,002 | 8/1902 | Allen | 400/487 |
| 2,728,816 | 12/1955 | Kao | 400/484 X |
| 3,809,204 | 5/1974 | Ogawa | 400/110 |
| 3,852,720 | 12/1974 | Park | 400/110 X |
| 3,927,752 | 12/1975 | Jones et al. | 400/484 X |
| 3,950,734 | 4/1976 | Li | 400/110 X |
| 4,096,934 | 6/1978 | Kirmser et al. | 400/110 |
| 4,187,031 | 2/1980 | Yeh | 400/484 X |
| 4,270,022 | 5/1981 | Loh | 400/484 X |
| 4,294,550 | 10/1981 | Wang | 400/110 |
| 4,327,421 | 4/1982 | Wang | 400/110 X |
| 4,408,199 | 10/1983 | White et al. | 400/110 X |

FOREIGN PATENT DOCUMENTS

| | | | |
|---|---|---|---|
| 0101479 | 8/1980 | Japan | 400/484 |
| 0142677 | 11/1980 | Japan | 400/484 |
| 0162134 | 12/1980 | Japan | 400/484 |
| 56-71131 | 6/1981 | Japan . | |
| 0037726 | 3/1983 | Japan | 400/484 |
| 2033633 | 5/1980 | United Kingdom | 400/110 |

OTHER PUBLICATIONS

Undated Multitech Industrial Corporation, brochure titled "Dragon Terminal".

Undated Transtech International, brochure titled "Sinoterm".

*Information and Computer,* Nov. 24, 1982; vol. 3, Issue 5, No. 29; Taipei, Taiwan.

*Primary Examiner*—Ernest T. Wright, Jr.

*Attorney, Agent, or Firm*—Phillips, Moore, Lempio & Finley

[57] ABSTRACT

A keyboard is disclosed for an ideographic language, in particular for Japanese. The disclosed keyboard includes the positioning of up to eight similar descriptors on a single key. Combination of the descriptors to form compound or complex ideograms is accomplished by actuating two or more keys in the usual order of "writing" a Japanese character.

8 Claims, 12 Drawing Figures

Microfiche Appendix Included
(1 Microfiche, 50 Pages)

FIGURE 4
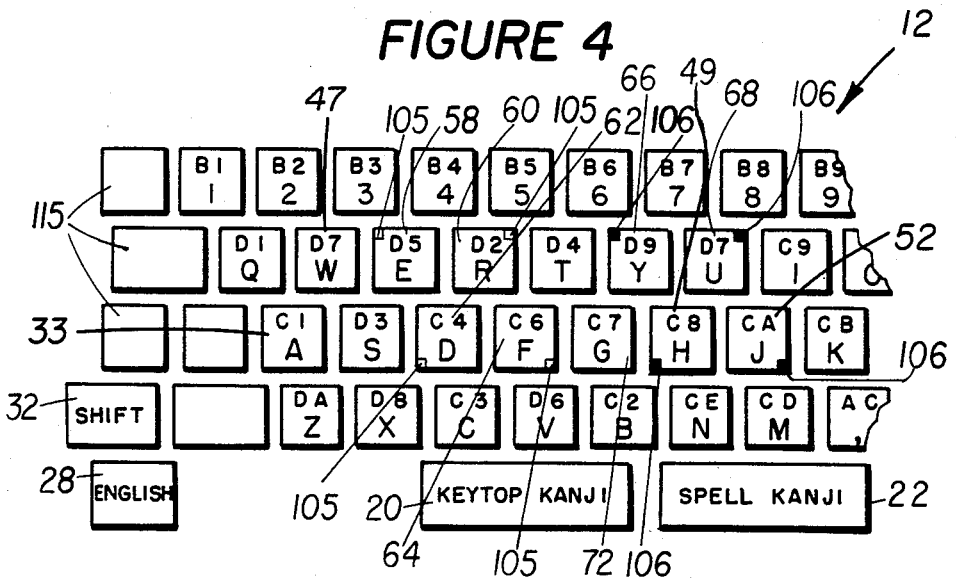
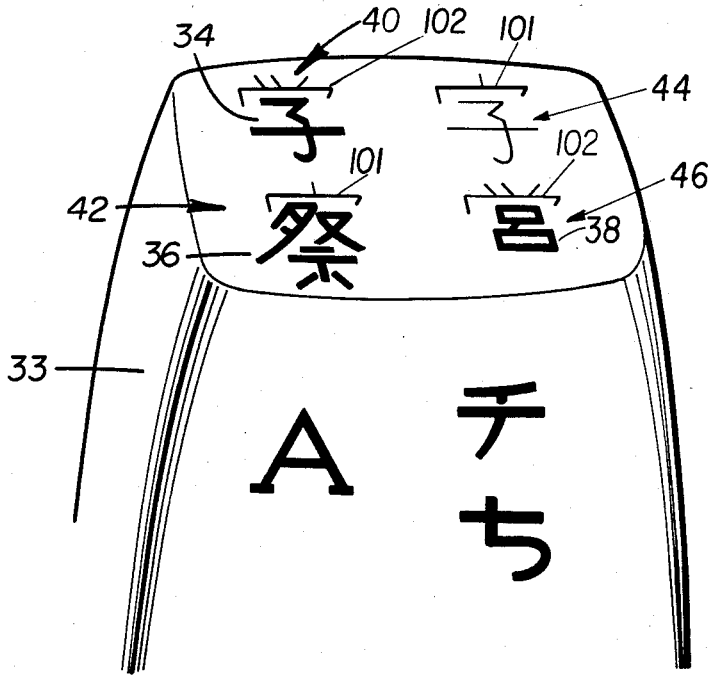
FIGURE 4A

IDEOGRAPHIC WORD PROCESSOR

A computer program of 50 pages on a micro-fiche forms Appendix A hereto.

TECHNICAL FIELD

This invention relates to data processing equipment. In particular, it relates to construction of a keyboard for an ideographic language.

BACKGROUND ART

Ideographic languages such as Chinese, Japanese, or hieroglyphics are particularly difficult to adapt to an automated system such as a word processor or the like. The simple reason is that an ideographic language is comprised of an open-ended and unordered number of symbols, each representing a word or a concept. The more familiar alphabetic type of languages such as English, German, French or the like, are based upon the construction of words from a finite number of ordered characters. In English, the number is 26, the number of letters in the English alphabet. As a consequence, automation of office procedures and construction of an English typewriter was relatively easy. Similarly, other alphabet-type languages such as Russian or Hebrew are relatively easily applied to a keyboard with relatively few keys. On the other hand, the construction of a "typewriter" with relatively few keys to reproduce Oriental ideograms, either on a display screen or by printing, has lagged behind Western developments. For the most part, the failure to develop an efficient and adequate ideographic keyboard which is easily learned and of a compact size, is attributable to the massive number of characters utilized in the Japanese, Chinese, and Korean languages.

There have been efforts over the years to overcome the problems of mechanically generating an ideographic language from a keyboard. One of the early efforts occurred after the advent of the telegraph. The Chinese linguists developed a dictionary of about 8,000 to 9,000 characters and associated with each character an Arabic number. This permitted the telegraph operators in the Orient to transmit a series of numerals of up to four digits in a group to signify a character. While this achieved the rudimentary goal desired at the time, it did not permit the complete expression of ideas to be transmitted or developed.

Early efforts in developing ideographic keyboards have required large numbers of keys (for example, about 200), with each key controlling several characters, in order to accomplish any degree of flexibility. It is well known that, at least as far as the Oriental languages are concerned, combinations of characters or combinations of something less than a character may form new words. Thus, the relatively limited number of keys, such as 200, proved workable in the early days of automation. However, in recent years, with the explosion of technology, it has proved difficult to keep up with the needs of business with such complex keyboards, which are difficult to use, not to mention the long and tedious learning process associated with their use.

Present technology includes a Kana-Kanji conversion system available on a keyboard having about 50 keys. In this system, the operator "types" in the sound of the Kanji character in Kana. The Kanji homophones are then displayed on a screen for selection by the operator. Since there may be numerous homophones, the system is limited to a search and retrieve operation rather than a true "touch typing" system.

Efforts to classify the Oriental character set into a workable number of descriptors or components have resulted in various schemes, most notably the three-corner system where the user identifies the shape of the character by reference to the corners. In order to avoid awkwardness, a large number of keys is still required when using the three-corner system.

As is well known, the Japanese language utilizes a subset of the Chinese character set, with the addition of the Katakana and Hiragana character sets. While the Chinese character set is open-ended and may have in excess of 60,000 or 70,000 identifiable characters, the Japanese character set, which is commonly referred to as Kanji, used approximately 10,000 to 15,000 of the Chinese characters. Of these 10,000 to 15,000 characters, about 2,500 are sufficient to provide 99.9 percent of the characters found in a newspaper, with about 600 characters being sufficient to convey an idea. While the smaller Kanji character set is more easily mastered than the more complex and larger classical Chinese character set, a keyboard to support the 2,500 newspaper characters would still be cumbersome if it were not possible to classify or break down the Kanji character set into smaller pieces. In many instances, the Kanji character set has been broken into "descriptors" which may be "less than" a word. However, even in these cases, the number of keys is large. Previous attempts to group like descriptor keys in the same vicinity have not proved overly successful because of the necessity to scan several keys to find the desired descriptor.

In addition to Kanji, the Japanese language includes the phonic-based "alphabets" of Katakana and Hiragana, each having about fifty or sixty symbols representing a sound. Katakana is particularly adapted to express sounds and assimilated words such as "baseball" and "computer." Hiragana is used for particles such as prepositions and also for grammatical endings.

With the interchange of technology with Western nations, some English words and many English corporate symbols, such as "IBM" or "GIT," are expressed in English letters interspersed in the middle of Japanese text expressed in Kanji.

Therefore, it is now necessary that automated word processing in Japanese include not only a relatively large Kanji character set (about 2,000characters), but also the Katakana, Hiragana and English character sets.

In existing keyboards adapted for Oriental languages, the number of keys is either large with the concomitant reduction of keystrokes/characters (about 600), or the number of keys is low (about 50) with a relatively high number of keystrokes per character.

Finally, earlier attempts to classify or group characters have been relatively unsuccessful when associated with the natural "writing" sequence taught to students of the Japanese written language.

DISCLOSURE OF THE INVENTION

The present invention is directed to overcoming one or more of the problems set forth above. The present invention is a method for constructing a keyboard for an ideographic language for use on electronic typewriters having a keyboard with fewer than 60 keys. The ideographic language consists of classes of descriptors, each of which forms at least a portion of an ideogram. The method comprises the steps of associating a descriptor from one of the classes of descriptors with a particular key, and secondly positioning other descriptors of that class within at least one key distance of the aforesaid key.

The present invention also includes the structure for a keyboard-based ideographic language word processor which includes a microprocessor, and an output device with the keyboard comprising a set of less than 60 manually operable keys, each key capable of forming a class of characters, have similar characteristics, wherein the universe of ideograms is greater than 2,500 characters.

The method and structure disclosed herein overcomes the problem of the massive number of keys used in the past on ideographic language typing machines and the like. It further, and more importantly, locates coherent or similar descriptors in adjacent areas or, preferably, on the same key. Thus, the primary object of the present invention is to provide a keyboard with a minimum number of keys and the further advantage of having coherent descriptors positioned on or adjacent to the same key.

BRIEF DESCRIPTION OF THE DRAWINGS

FIG. 4 is a diagram of the keyboard shown in FIGS. 2 and 3 with the corresponding English letters found in a QWERTY keyboard.

FIG. 4A is a perspective of a single key as used in this invention.

BEST MODE OF CARRYING OUT THE INVENTION

Figure 1:
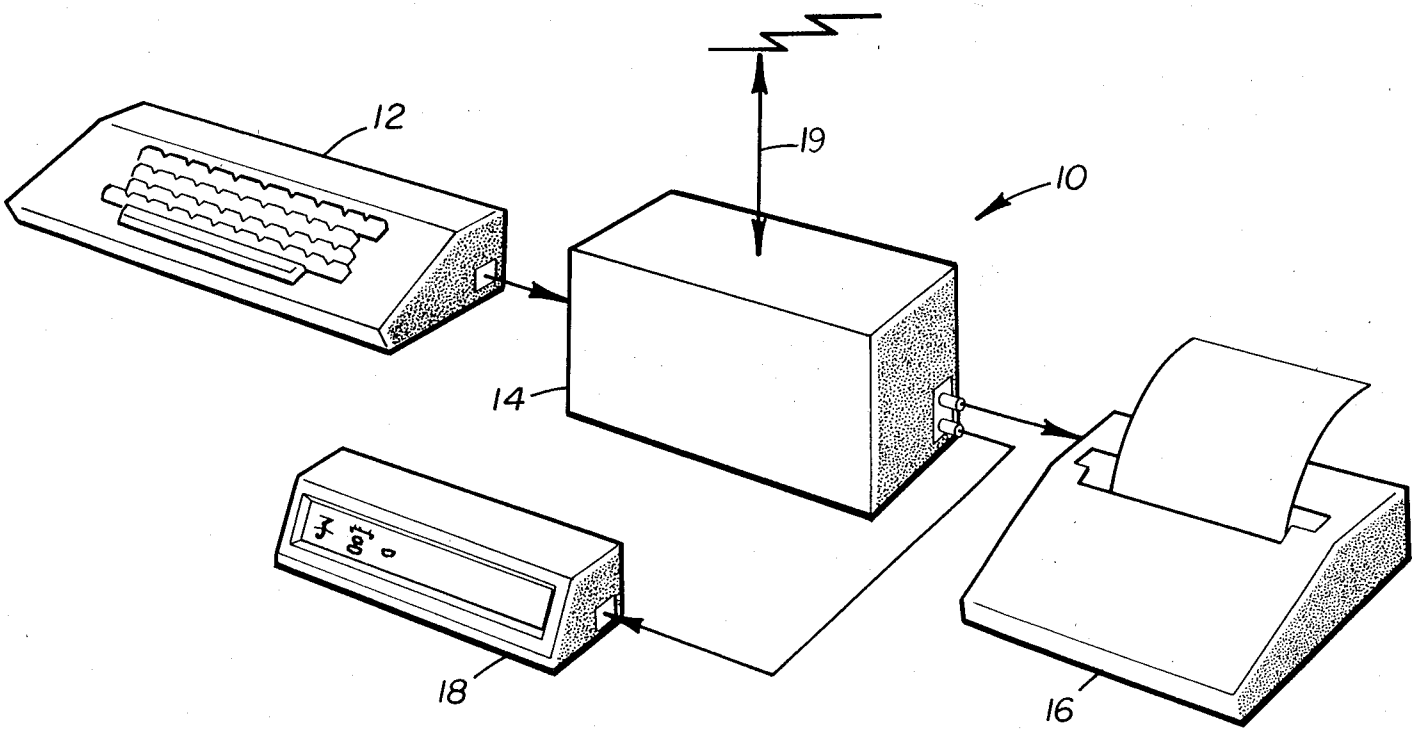
FIG. 1 is a schematic diagram of the structure embodied in the present invention.

Referring now to FIG. 1, a schematic diagram of a computer system 10 is depicted. Computer system 10 includes a keyboard 12 to be used for entry of data into a microprocessor or CPU 14 which, after appropriate manipulation, may produce human-readable data on either a printer 16 or a visual display device such as the LCD array 18. In addition, CPU 14 is capable of transmitting or receiving data through a communications channel 19 which may be coupled with a modem (not shown) or the like to accomplish the necessary communications features. LCD array 18 may be replaced by a cathode ray tube or other visual display device and still stay within the confines of this invention.

Preferably, printer 16 is of the dot matrix variety; however, an ink jet printer wherein the character may be "drawn" upon paper output would also suffice. It is important to note that both the LCD array 18 (or its counterpart, a CRT) and printer 16 must be capable of constructing the various shapes that represent words, syllables, sounds, or the like, in ideographic languages. In addition, both LCD array 18 and printer 16 should have the capability of producing alphabetic character sets such as the English alphabet, along with Arabic numerals and conventional punctuation marks.

Figure 2:
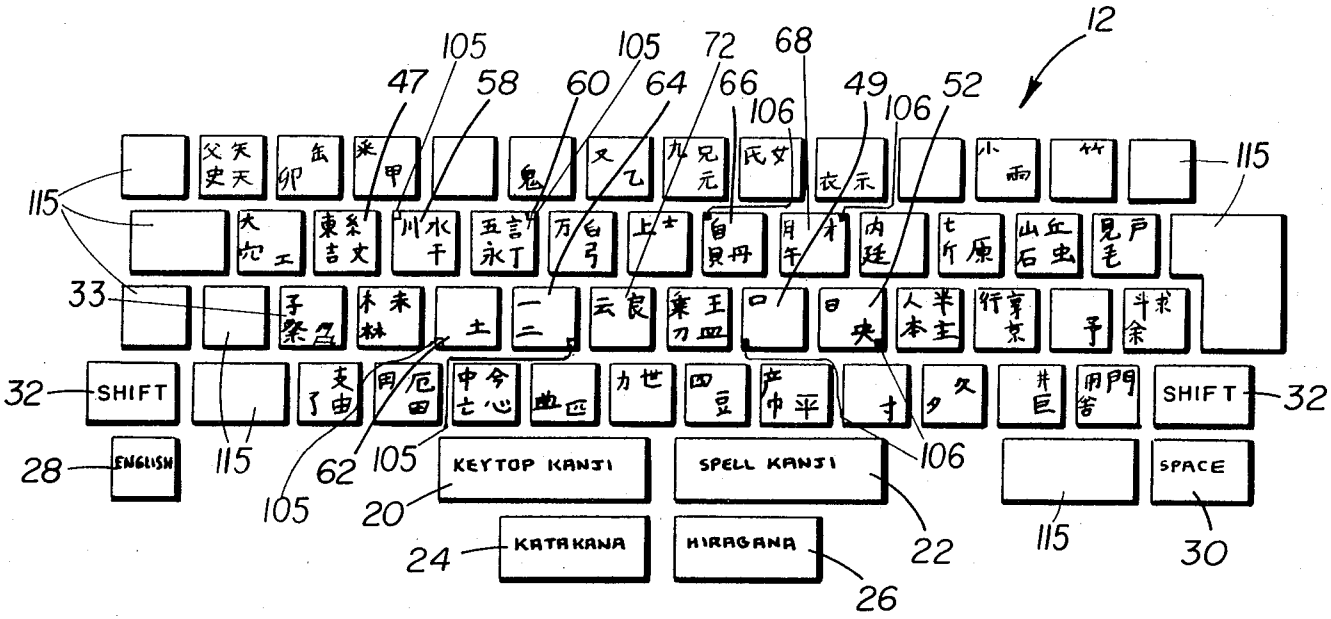
FIG. 2 is a diagram of the keyboard layout of an embodiment of this invention showing the embedded ideograms associated with each key.
Figure 3:
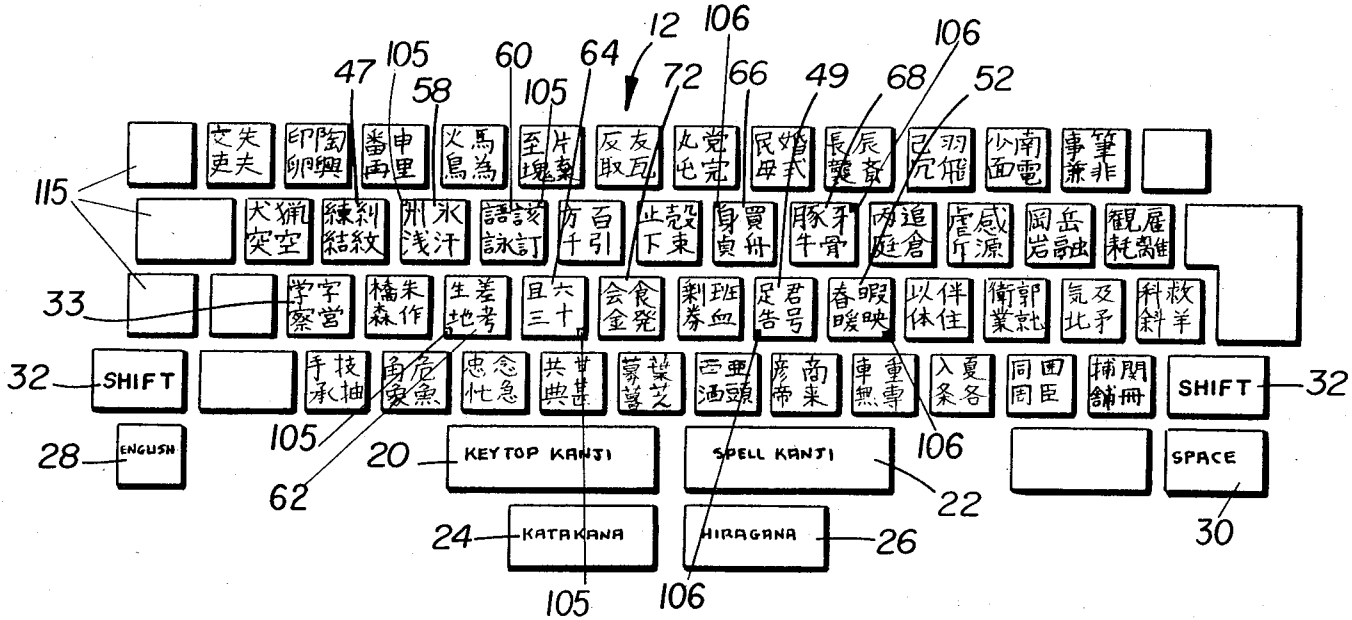
FIG. 3 is a diagram of the full keyboard layout of the embodiment of this invention shown in FIG. 2.

Referring now to FIGS. 2, 3, and 4, keyboard 12 is shown with its various type fonts associated with the key members. It is important to understand that keyboard 12 is essentially a standard keyboard as used either for a word processor or a computer input terminal in the English language environment. Thus, in FIG. 4, the characters associated with the keys follow the standard QWERTY format almost universally in the English-speaking world. Also shown in FIG. 4 are hexidecimal codes, representing the eight bits or one byte that uniquely identifies the English character. This eight-bit byte is formed by utilizing the seven-bit ASCII code with a leading one bit. Thus, the ASCII code for the letter "A" is 1000001, while in the eight-bit representation, this code becomes 11000001 or C1 in hexidecimal notation. It should be noted that the code associated with a particular key, while herein denoted as a hexidecimal code based on the standard ASCII code, is not controlling. The controlling point is that each key have a unique code associated with it, such that when the key is depressed, that unique code or signal is made available to CPU 14.

Referring to FIG. 2 and FIG. 3, it can be seen that various Oriental, in this case Japanese, characters are also associated with each key. In FIGS. 2 and 3, the conventional space bar found on the English typewriter has been replaced with four thumb-bars 20, 22, 24, and 26. Before detailing the function of these four bars 20, 22, 24, and 26, it is appropriate to say that in the Japanese ideogram system there exist three distinct character sets. The Kanji character set is based on the Chinese ideographic character set and is substantially open-ended. That is to say, the number of characters available to the Kanji author is relatively unlimited when compared to a finite alphabet set, such as English. It is known, however, that command of approximately 3,000 Kanji characters will enable the author to express in writing approximately ninety-nine percent of his ideas, while command of about 600 characters permits rudimentary communication. In addition to the Kanji character set, the Japanese utilize two syllabaries, which are represented by the Katakana and Hiragana character sets. These two character sets are finite and each set consists of about fifty symbols. The two "kana" character sets and about 3000 of the Kanji characters are included in a Japanese Industrial Standard (JIS). 1,945 of the JIS Kanji characters are included in JOYO, an official Japanese government list of characters that must be learned to enter the secondary school system in Japan.

In addition to the four thumb-bars 20, 22, 24 and 26, an additional key 28 provides an English character set (also included in the JIS) as represented by FIG. 4. A space-bar 30 and shift keys 32 are included as an integral part of this keyboard 12. The unmarked keys such as keys 115 in FIG. 3 contain conventional punctuation marks and other functional keys necessary to operate the particular computer utilized.

Figure 5:
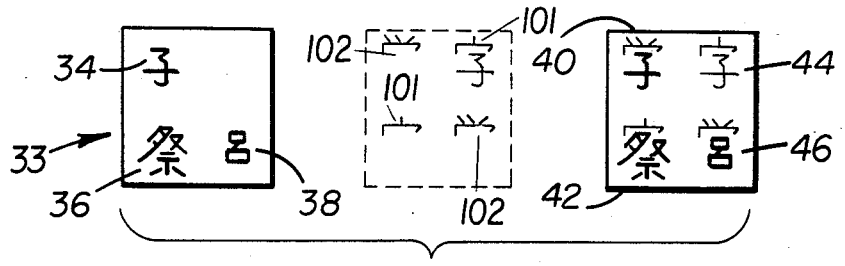
FIGS. 5, 6, 7, and 8 are individual keys of the keyboard shown in FIGS. 2 and 3.

Referring now to FIG. 4A, the layout of key 33 is illustrated. The particular key 33 illustrated in FIG. 4A corresponds to the first character key in the third row in FIGS. 2 and 3 and the "A" key shown in FIG. 4. Reference may also be made to FIG. 5, wherein the Japanese characters are depicted that appear on the top of the key 33 being described. It will be noted in FIG. 4A that certain portions of the characters in the upper left, the lower left, and the lower right of the surface of the key 33 are shown in heavier black lines. These characters correspond to the characters shown in the keyboard in FIG. 2. The heavier lined portion, along with the lighter lined portion, form the complete set as shown in FIG. 3. For information, the upper left character, which is numbered 34 in FIG. 5, is the Japanese character for "child." The lower left character 36 translates to "festival." The lower right character 38 corresponds to "bath."

Referring specifically to FIG. 5, it can be seen that the three characters 34, 35, and 38 shown in the leftmost portion of FIG. 5, and appearing on the surface of the key 33 in FIG. 2, have added thereto certain similar members. In particular, a horizontal line with upstanding lines (101 or 102) is added to the characters 34, 36, and 38 as shown in the center and right blocks of FIG. 5. In FIG 4A where the composite character is shown, it can be seen that these added portions are done in a lighter typestyle. It may be convenient on the keyboard 12 to use different colors such as red and black, or blue and black. The composite figure, as shown in the rightmost portion of FIG. 5, may be translated as follows. The upper left character 40 corresponds to the English word "learn"; the lower left character 42 corresponds to the word "realize"; the upper right character 44 corresponds to the word "word"; while the lower right character 46 corresponds to the word "manage." The result of the grouping on this particular key 33 can be readily seen in that the character 34 for the word "child" appears twice on the key 33 in FIG. 3. However, each of the added portions as shown in FIG. 5 includes a horizontal line with down-turned ends and some upstanding portions above the horizontal line. To one seeking to "type" in Japanese, a similarity in shape is found in the structures shown in FIG. 5.

Figure 6:
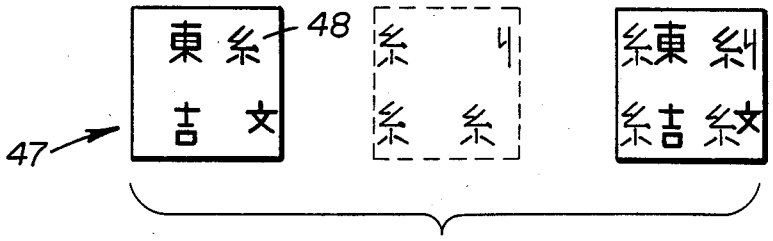

Referring now to FIG. 6, a detail of the key 47, which corresponds to the "W" key on an English typewriter, is shown. The common thread on this key 47 is the character for the English word "thread" 48 located in the upper right corner of the leftmost representation in FIG. 6. Referring to the dashed or added portions shown in the center of FIG. 6, it can be seen that the character for "thread" 48 is added in the two left positions and the lower right position so that the characters formed in the rightmost key and appearing on the keyboard in FIG. 3 all have the common characteristic of the "thread" 48 character associated therewith. Thus, to a Japanese typist desiring to reproduce the character for "thread" 48 or for any other character that utilizes the character "thread" 48 as a portion of the composite character, he need only learn one key.

For continuity's sake, the remaining characters in FIG. 6 are as follows:

| (Left Portion-as in FIG. 2) | | (Right Portion-as in FIG. 3) | |
|---|---|---|---|
| East | Thread | Training | Substance |
| Yoshi | Text | Bind | Family Crest |

Figure 7:
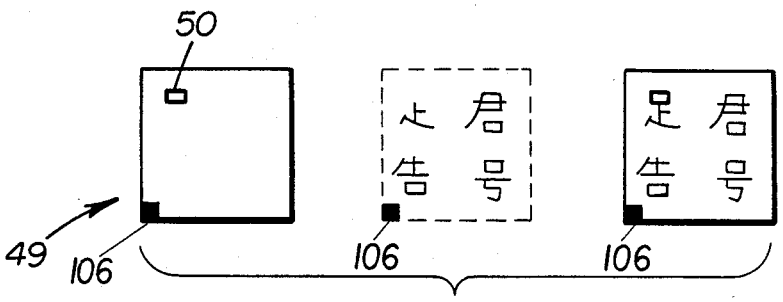

The key denoted as 49 in FIGS. 2 and 3 has the common character 50 representing the English word for "mouth." Referring to FIG. 7, it can be seen how mouth is combined with other characters to form, respectively, in the upper left corner "foot," in the lower left "report," in the upper right "a familiar name ending," and in the lower right "number."

Figure 8:
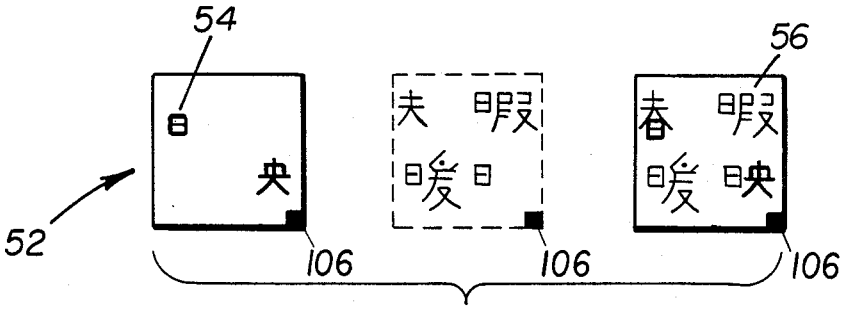

Looking at the "j" key 52, the common element is in the upper left corner 54 and represents the character for "sun." Combining the character for "sun" as shown in the righthand portion of FIG. 8, a double coherence is illustrated. The character for "sun" which appears in the upper left, lower left, and lower right character is modified to form, respectively, in the upper left "spring," in the lower left "warm," and in the lower right "movie" or "reflection." These three characters are associated with the fourth character 56 which represents "holiday." Thus, the coherence of the "sun" is tied to a fourth character which is associated with the sun, namely, "holiday." Thus, the Japanese typist, knowing the location of the character "warm" or "sun," would be led immediately to the character "holiday" which appears on the same key 52.

Referring now to FIG. 2, special reference will be made to the family and locater keys. In order to activate a Kanji character depicted in FIG. 2, the typist may select the quadrant in which that character is located. This is accomplished by first depressing the keytop Kanji key 20 followed by, for the upper lefthand character in FIG. 2, the key numbered 58. For the upper righthand character in FIG. 2, the key is 60. For the lower lefthand character, the key is 62. For the lower righthand character, the key is 64. Similarly, the characters depicted in FIG. 3 are selected by the family and locater key 66 for the upper lefthand character, 68 for the upper righthand character, 49 for the lower lefthand character, and 52 for the lower righthand character. It will be noted that in FIGS. 2 and 3, these quadrants are depicted by small squares (105 or 106) in the appropriate corners of these keys, with the imbedded keytop character shown in FIG. 2 having an open square 105 and the full character shown in FIG. 3 having a filled-in square 106.

Referring again to FIG. 4A, key 33 or the "A" key is shown in a perspective view. As previously noted, the character for "child" 34 is shown in the darker typescript, while the character 40 for "learn" includes the character for "child" 34 and the lighter "roof" fixed above it. Similarly, the character for "festival" 36 forms the darker portion of the composite character for "realize," 42. On the front face of the key 33, the English character "A" appears in capital form. Similarly, the Katakana character "chi" appears to the right of the English letter "A" with the Hiragana character for "chi" appearing just below the Katakana character. In the case of an English character that requires a shift, such as one of the number keys, the upper and lower case will appear on the front surface of the key in the manner of the Katakana and Hiragana character sets.

Referring now to the characters on key 58 as depicted in FIG. 2, the subject matter type coherence is best illustrated. In FIG. 2, the character in the upper lefthand corner corresponds to the English character for "river" while the character in the right corner corresponds to "water" and the character in the lower right corresponds to the English word for "dry" or "parched."

Referring to FIG. 3 and key 58, the character in the upper left corner corresponds to "geographic state." In the lower lefthand corner, it corresponds to "shallow"; in the upper righthand corner to "ice"; and in the lower righthand corner to "sweat." As can be seen, "river" corresponds to "geographic state" in that the "river" would separate the two states, while "ice" corresponds to "water," and "dry" or "parched" is the antonym for "sweat." The character for "swallow" is related to the two basic characters found in FIG. 2 for "river" and "water."

Finally, while not shown, left-right and top-bottom based on symmetry may also be used.

OPERATION OF THE PREFERRED EMBODIMENT

The preferred embodiment of this ideographic keyboard 12 can best be described in relation to FIG. 1, wherein the operator is seated at keyboard 12 and wishes to enter Japanese characters into CPU 14 for display on LCD array 18, for printing on printer 16, or for transmission through appropriate transmission means 20.

Figure 9:
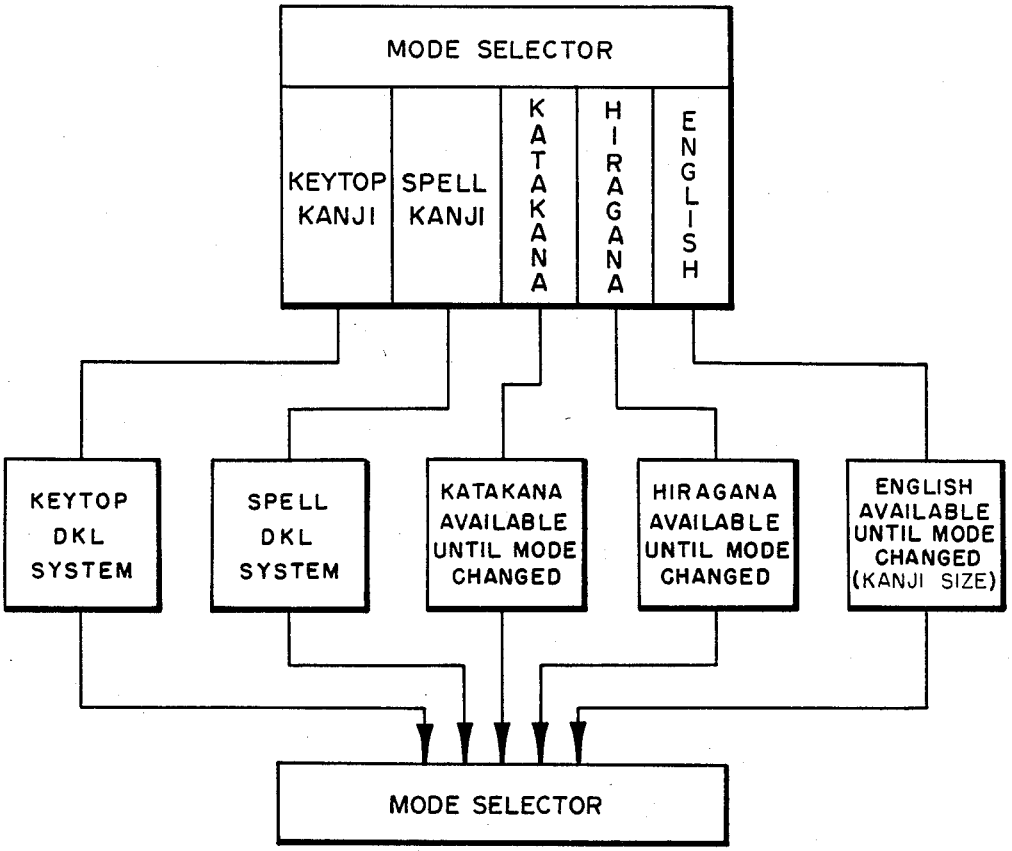
FIG. 9 is a mode selector flow chart associated with this invention.

The operator has the choice of the five modes as illustrated in the flow chart in FIG. 9; particularly, keytop Kanji through key 20, spell Kanji through key 22, Katakana through key 24, Hiragana through key 26, or English through key 28. Each mode will be described hereafter.

THE KEYTOP KANJI MODE

Should the explicit character be located on the keytops (for example, the character for "child" depicted in FIG. 5 as numeral 34), the operator will actuate the keytop Kanji key 20 initially, followed by depressing key 33, which contains the character 34; then depressing family and locater key 58. The delimiter key should then be depressed, which in this instance would be the next mode key. Should the operator wish to utilize the character for "training," the keytop Kanji key 20 will again be depressed. Key 47 will be followed by the family and locater key 58.

Figure 11:
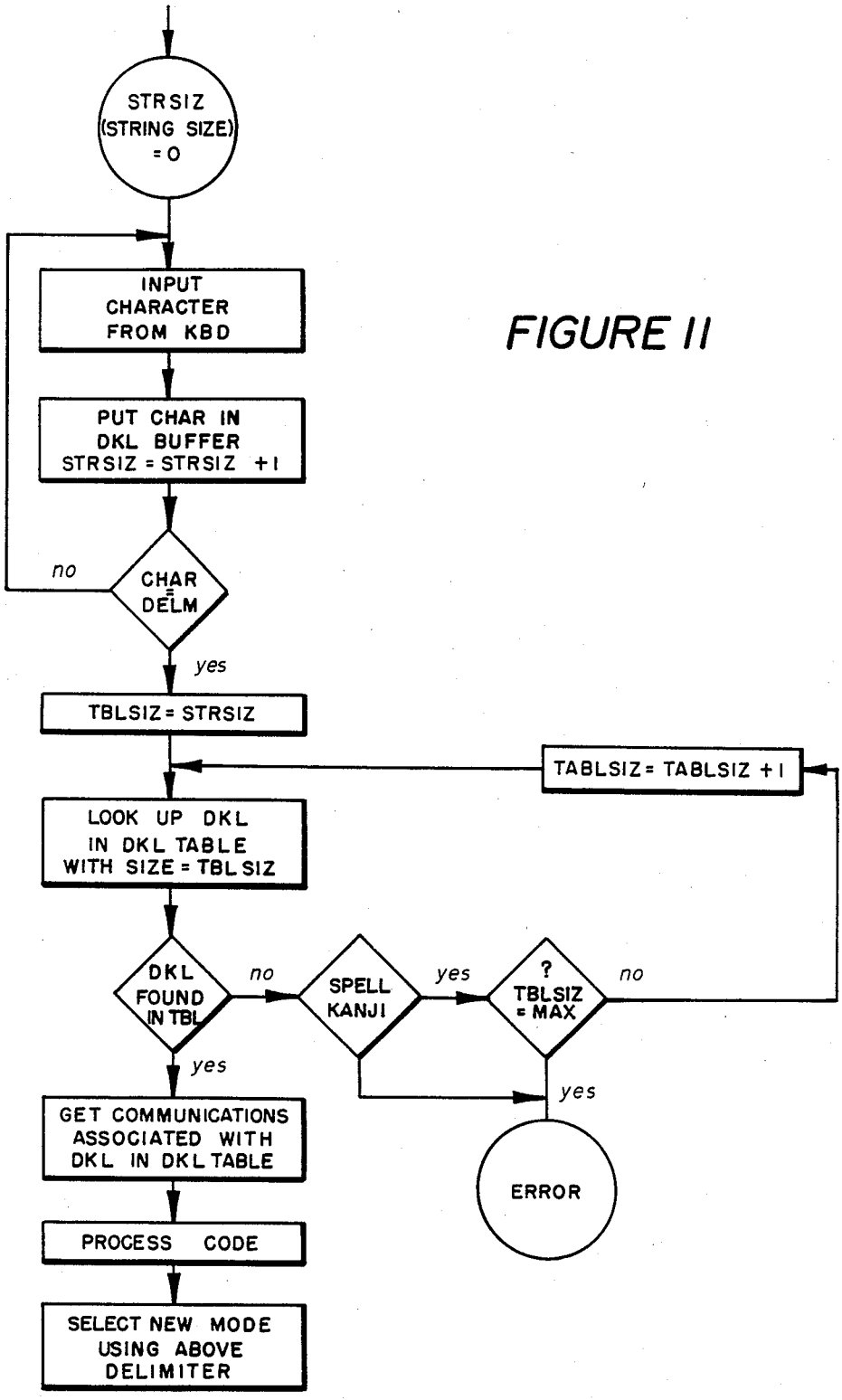
FIG. 11 is a flowchart of the table look-up sequence for each character.

Reference to FIG. 11 will indicate the internal processing of the CPU 14 by the associated software. Specifically, when a mode is selected (e.g., keytop Kanji 20), a string size is set to zero pending the input of a character from the keyboard 12. From the first example set forth above wherein the character 34 for "child" was selected, the first character entered was the character key 33. This key 33, which for convenience's sake is represented on the English character keyboard 12 as the letter "A" having a hexidecimal code "C1," is placed in a buffer and the string size incremented by one. The flow chart then checks to see if a delimiter key (i.e., a new mode selection) has been entered. In this illustration, that has not occurred yet. The second characteris represented by locator key 58, which carries the hexidecimal code "C5." This character is also stored in the buffer and the string size is incremented again. The string size is now at two. Since the character has been "constructed," the operator would hit the delimiter key, in this case the keytop Kanji key 20, to proceed with the next character, which it may be remembered was "training." Following through the flow chart in FIG. 11, the string size is entered into the table size and a lookup is made in a DKL table. DKL, in this invention, is an abbreviation for "delimiter Kanji length." The software associated with this program and the associated tables are constructed so that the string size points to a particular table. Thus, single character representations are in one table, two character representations in a second table, and three character representations in a third table. This facilitates the lookup by reducing the total number of looks. It has been found convenient to use a traditional binary search to reduce the number of looks. If the DKL is found, then the program would go through the procedure of retrieving the code to construct the character on the appropriate output device. The code used to identify the character is the Japanese Industrial Standard (JIS) code, which consists of two eight-bit bytes. Finally, the bit map necessary to depict the character on the LCD 18 or the printer 16 is retrieved and the character is "built." In the event communications with another unit through the communications modem 20 is desired, the DKL code can be sent directly, or the JIS code associated with the DKL may be sent.

THE SPELL KANJI MODE

If the character is not available on the keyboard 12, then the operator must generate that character utilizing the spell Kanji mode. Referring to FIG. 9, it can be seen that the "spell Kanji" key 22 replaces the keytop Kanji delimiter discussed in the previous section. Referring now to the flow chart in FIG. 11, the spell Kanji delimiter in the form of key 22 is first activated. Let us assume that the character for "shrine" (宮) is desired. The elements for the character "shrine" are found on FIG. 5 and include the character for "bath" 38 (呂) and the character for "roof" (宀), which forms the other portion of the word "shrine." This "roof" portion is a part of the full text form shown on FIG. 3 at key 33 forming a part of the character for "word" 44 and the character for "realize" 42.

In the spell Kanji mode, the flow chart shown in FIG. 11 is followed in the same manner as the keytop Kanji; however, at the decision block "DKL found in table," a second decision block is utilized to determine if it is in the spell Kanji mode. In the keytop Kanji, if the DKL is not found in the table at that time, an error message is printed. In the spell Kanji mode, the table size is checked to see if it is at maximum, and if not, the table size is incremented by one and a second look up in the next size table is accomplished.

In displaying the character for "shrine," the delimiter Kanji list code points to the JIS code for the character "shrine", which in turn looks to the bit map for that character to produce the visual display.

Similarly, the character for "united" (合) is constructed by first depressing the spell Kanji key 22, followed by pressing key 72 to obtain the rooflike character (人) in the two leftmost positions on key 72, followed by depressing key 49 to obtain the character for "mouth" (口). Here again, the software tables will construct the character for display on the screen 18 or for printing through a dot matrix.

Storage of the characters in bit map form in the computer memory for both the keytop Kanji and the spell Kanji may be accomplished by a system similar to that described in U.S. patent application Ser. No. 186,580 filed Sept. 12, 1980 and assigned to the assignee herein now U.S. Pat. No. 4,408,199. In both keytop Kanji and spell Kanji, it should be remembered that a delimiter indicates the end of the character string. Ordinarily, this delimiter as indicated in FIG. 9 is the selection for the next character. That is, if the next character is to be constructed by keytop Kanji, then depressing the keytop Kanji mode for the next character acts as the delimiter character for the previous character.

THE KATAKANA AND HIRAGANA MODE

Katakana and Hiragana differ from the keytop Kanji and the spell Kanji in that the operator remains in that mode until a new mode is selected (FIG. 9). As can be seen in FIG. 4A, the Katakana and Hiragana characters are located on the face of the keys and thus entry by the keys is accomplished by a single stroke.

THE ENGLISH MODE

English is available in two font sizes in both upper and lower case. The Japanese character set is such that, periodically, English words or the like are intermixed with the Oriental character set, since those words or logos may not be readily translatable into the Oriental character set. For example, the corporate logos for IBM and for GIT may very well be used in Japanese text and pronounced by the Japanese by their syllabary. In the instant application, these intermixed English words or logos are formed in a relatively large type font and are obtained by entering the English mode by depressing key 28 for each letter.

Figure 10:
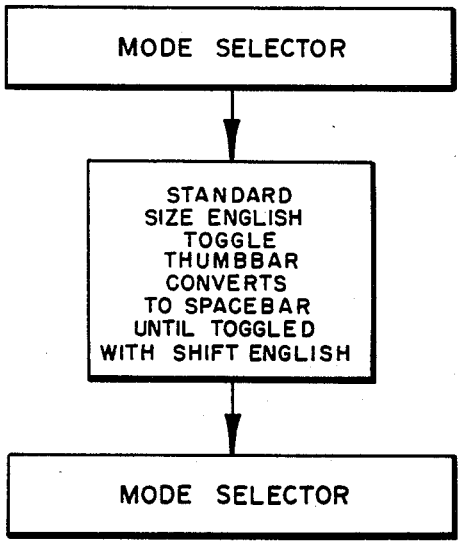
FIG. 10 is a detail of the English language mode selection of this invention.

On the other hand, full text English, numerals, and punctuation may be obtained by entering the English mode with the key 28 and the shift bar 32. This provides a smaller type font than the Kanji characters generated in either the spell Kanji or keytop Kanji mode. When in this mode, the keytop Kanji and the spell Kanji thumb bars 20 and 22 respectively are converted to standard English space bars as indicated in FIG. 10, and the keyboard 12, to all intents and purposes, acts as an English-language typewriter. To return to one of the other modes, i.e., keytop Kanji or spell Kanji, one need only select the mode desired and return to the sequence indicated in FIG. 9.

Previous Kanji keyboards have required an average of about 2.7 strokes per character in a Kana-Kanji mixed text to obtain the 1,945 JOYO Kanji characters, which account for over ninety-five percent of the Kanji usage. The instant keyboard system 10 reduces this keystroke per character to about 1.84 keystrokes per character, thus markedly improving the efficiency of the Japanese operator.

While this invention has been described using the Japanese character set, it should be understood that other applications are envisioned. For example, a "short hand" English keyboard is possible where like syllables are co-located on the same or adjacent keys.

Other aspects, objects, and advantages of this invention can be obtained from a study of the drawings, the disclosure, and the appended claims.

We claim:

1. A method for constructing a keyboard for an ideographic language for an electronic typewriter, the keyboard having fewer than sixty (60) keys, the ideographic language consisting of classes of descriptors each of which forms at least a portion of an ideogram, the method comprising the steps of:

associating a descriptor from one of the classes of descriptors with a key;

positioning all remaining descriptors of the class within at least one key distance of the aforesaid key.

2. The method of claim 1 further comprising the step of positioning at least three descriptors of the same class on a single key and the supplemental step of providing a locater key for use in preselecting one of the three descriptors on the single key.

3. The method of claim 1 further comprising the step of providing a computerized system to distinguish allowed combinations of two or more sequenced keystrokes that are used to build an ideogram composed of two or more descriptors.

4. The method of claim 1 further comprising the steps of:

separating a descriptor into color-coded segments;

providing color-coded keys for use in preselecting a color-coded segment.

5. The method of claim 2 further comprising the steps of:

separating a descriptor into color-coded segments;

providing color-coded keys for use in preselecting a color-coded segment.

6. The method of claim 3 further comprising the steps of:

separating a descriptor into color-coded segments;

providing color-coded keys for use in preselecting a color-coded segment.

7. The method of claim 1 further comprising the steps of providing a computer system associating a unique eight bit code with each key; and providing a computer program to distinguish allowed combinations of two or more sequences of eight bit codes.

8. In combination with a microprocessor, an input keyboard for an ideographic language comprising:

less than 48 keys, each key having no more than four first ideographic descriptors depicted on the upper surface thereof arranged in a generally square pattern and in a first color forming at least a portion of a first family of descriptors each of said less than 48 keys having no more than four second ideographic descriptors depicted on the upper surface thereof arranged in the same generally square pattern, each of said second ideographic descriptors consisting of one of said first ideographic descriptors in said first color and an additional portion of said second ideographic descriptor depicted in a second color forming at least a portion of a second family of descriptors;

a family control key to select the first or second family of descriptors;

four locater control keys to select one of the first or second descriptors by corner.

* * * * *